United States Patent [19]

Thompson et al.

[11] 3,963,299

[45] June 15, 1976

[54] BONDING ASSEMBLY FOR INSTALLATION ON A SHIELDED CABLE

[76] Inventors: John T. Thompson, 244 Loring St., Los Angeles, Calif. 90024; George W. Gillemot, 2331 - 20th St., Santa Monica, Calif. 90405

[22] Filed: Feb. 3, 1975

[21] Appl. No.: 546,289

Related U.S. Application Data

[63] Continuation of Ser. No. 295,509, Oct. 6, 1972, abandoned, which is a continuation-in-part of Ser. No. 257,692, May 30, 1972, abandoned.

[52] U.S. Cl. ..... 339/95 R; 24/263 A; 85/1 JP; 151/41.73; 339/263 R

[51] Int. Cl.[2] ..... H01R 11/20

[58] Field of Search ..... 339/14, 95, 97, 263, 339/264, 266; 85/1 JP, 32 K; 151/41.73; 24/115 R, 135 R, 135 A, 263 LS, 263 A

[56] References Cited

UNITED STATES PATENTS

| | | | |
|---|---|---|---|
| 1,212,708 | 1/1917 | Steinberger | 24/115 R |
| 2,437,339 | 3/1948 | Webster | 339/95 R |
| 2,443,996 | 6/1948 | Tenney | 339/266 R |
| 3,251,104 | 5/1966 | Sylvester | 24/135 R |
| 3,253,247 | 5/1966 | Vos | 339/95 R |
| 3,654,584 | 4/1972 | Gillemot et al. | 339/95 R |
| 3,659,153 | 4/1972 | Neuber | 339/14 R |

FOREIGN PATENTS OR APPLICATIONS

| | | | |
|---|---|---|---|
| 1,096,991 | 1/1961 | Germany | 339/266 R |
| 909,716 | 4/1954 | Germany | 339/266 R |

*Primary Examiner*—Joseph H. McGlynn
*Attorney, Agent, or Firm*—Harris, Kern, Wallen & Tinsley

[57] ABSTRACT

A cable bonding assembly and method of installing the same on a shielded cable without need for slitting either the shield or sheath. An inner shoe is forcibly inserted edgewise directly beneath the shield until a threaded opening therein registers with aligned openings through the shield and sheath spaced inwardly from the ends thereof. The threaded end of a clamping shank is then screwed into the threaded opening through the aligned opening and employed along with retainer means thereon to hold an outer shoe clamped against the exterior of the sheath and the inner shoe clamped against the shield. Sharp burrs associated with the inner shoe penetrate into and assure multiple positive contacts with the shield. Grounding of the bonding assembly may be by conductors secured to the shank, or to a second threaded shank fixed to one of said shoes, or by a metal clamp embracing the bonding assembly and a grounded metallic support for the cable end.

20 Claims, 7 Drawing Figures

BONDING ASSEMBLY FOR INSTALLATION ON A SHIELDED CABLE

This is a continuation of application Ser. No. 295,509, filed Oct. 6, 1972, now abandoned which is a continuation-in-part of our copending application for U.S. Pat. Ser. No. 257,692, filed May 30, 1972, and now abandoned.

This invention relates to bonding assemblies and installation techniques, and more particularly to an improved, solderless, bonding assembly for shielded cables designed for installation without neded for slitting either the shield or sheath and utilizing the strength of the sheath to provide an usually high-strength high-capacity bonding connection to the shield.

In out pending U.S. applications Ser. No. 77,371, filed Oct. 1, 1970 and 212,399, filed Dec. 27, 1971, there are disclosed solderless cable bonding assemblies now in widespread use and which have proven highly satisfactory. Each of these constructions includes a threaded shank having a large area head clampable against the inner surface of the cable shield by a retainer nut assembled over the shank and tightened against an outer cooperating clamping shoe. Owing to the attachment of the shank to the inner shoe, it is necessary to provide some type of opening, such as a slit of a notch, through the end of the shield and sheath, to facilitate assembly of the inner shoe lengthwise along and beneath the cable shield. This practice unavoidably weakens the strength of the mechanical aspect of the installation and the reliability of the electrical connection to the shield jacket. Slitting or notching the end of the sheath weakens the end of the sheath and usually requires serving the sheath with multiple convolutions of strong adhesive tape, the addition of a clamping band, or both.

By present invention there is provided an improved cable bonding assembly completely eliminating the need for slitting or notching the end of either the shield jacket or the outer sheath. Instead, an opening or punchout is formed through the shield and sheath in an area spaced completely inwardly from the cable end and is only large enough to accommodate the clamping shank which is separable from the inner shoe. The shoe is provided with a threshold opening in its central area and is inserted edgewise directly beneath the shield until its threaded opening is aligned with the previously formed shank seating opening. Thereafter either a headed or a non-headed threaded shank is inserted through these openings and tightened into the threaded bore. If a non-headed threaded shank is used the outer shoe is tightly clamped against the outer sheath by tightening retainer means thereagainst such as nut retainer means mounted on the shank. Alternatively, the threaded shank may have a head and a length such that the two shows are firmly clamped astride the shield and sheath as the shank bottoms in the threaded bore. Additionally, this alternate embodiment has a threaded shank fixed to one of the two shoes for use in clamping a grounding conductor to the bonding assembly. The installation operation is facilitated by inserting a sharp burred shim along with the inner shoe and the burns of which are effective to penetrate any film or layer of insulation sometimes present on the shield. Rotation of the outer shoe during assembly is prevented by the provision of tangs penetrating into the sheath. The outer shoe is also preferably provided with an outturned tang cooperable with the clamping shank to hold a grounding clamp band seated astride the outer shoe. If this band is tightened against a grounded support frame or stake, the bonding and grounding operation is completed by tightening this band which may serve additionally as an anchorage for the cable end.

It is therefore a primary object of the present invention to provide an improved cable bonding assembly and method for installing the same on a shielded cable.

Another object of the invention is the provision of a high mechanical strength and large capacity bonding assembly securable to a cable shield jacket in an improved manner and utilizing the strength of the cable sheath to an optimum extent.

Another object of the invention is the provision of an improved construction and technique for securing a bonding assembly to a cable shield jacket without need for notching or slitting the end of either the shield or cable sheath and wherein wide area metallic shoes are clamped one against the interior surface of the shield and the other against the outer surface of the cable sheath utilizing a threaded stud or a cap screw inserted through the outer shoe, sheath and shield into threaded engagement with the inner shoe.

Another object of the invention is the provision of shielded cable bonding assembly for clamping wide area portions of a cable shield and sheath between wide area metallic shoes by a cap screw extending radially through the parts and into a threaded bore of the inner shoe and utilizing a separate shank fixed to one of the shoes are equipped with retainer means for holding a conductor firmly assembled thereto.

Another object of the invention is the provision of a bonding assembly and method by which a cable shield and sheath may be clamped under very substantial pressures between a pair of inner and outer wide area metallic shoes utilizing a threaded clamping fastener assembled into threaded engagement with the inner shoe after the latter has been inserted edgewise between the cable conductors and the shield jacket.

These and other more specific objects will appear upon reading the following specification and claims and upon considering in connection therewith the attached drawing to which they relate.

Referring now to the drawing in which two preferred embodiments of the invention are illustrated:

Figure 1:
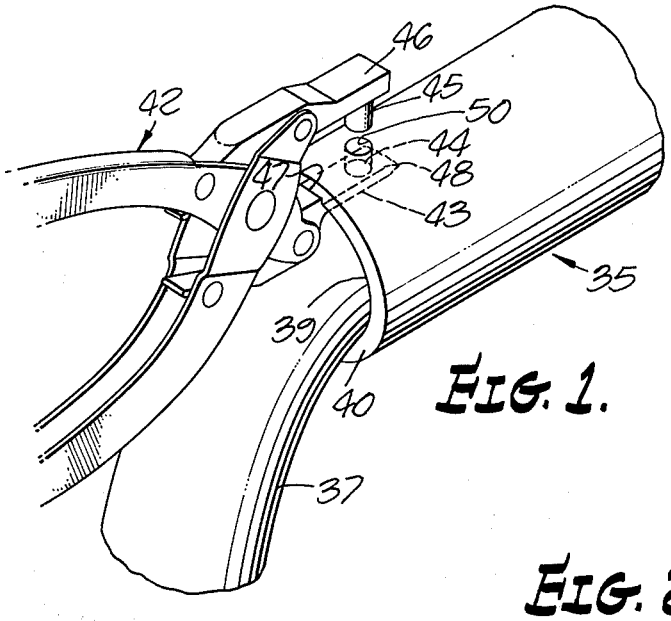
FIG. 1 is a fragmentary perspective view showing a typical shielded cable in the process of being prepared for the installation thereon of a first embodiment of the invention bonding assembly.

Referring to FIGS. 1–4, there is shown the invention bonding assembly, designated generally 10, comprising a large area inner shoe 11, a resilient shim 12, a large area outer shoe generally complemental in area and shape to the inner shoe, a clamping shank 14, and retainer means or lock nuts 15, 15. All components of the assembly are formed from metal of good conductivity and highly resistant to corrosion. Shoes 11 and 13 are here shown as curved complementally to one another and generally to the curvature of the cable to which they are to be assembled. However, it will be understood that the shoes need not be curved, particularly on large size cables, but it is desirable that their adjacent surfaces be parallel to one another. As here shown by way of example, the shoes are generally rectangular and stamped from heavy gauge sheet metal stock.

The central area of inner shoe 11 has a bore in which is press fitted a shouldered insert or collar 18. The latter has a threaded bore 19 which terminates at its inner end in a stop flange 20. The threaded shank 14 mates with thread 19 but the stop flange 20 limits the distance of assembly sufficiently to prevent the shank from contacting the cable conductors. It will be understood that the insert collar 18 can be dispensed with in which event threads 19 are formed directly in a shouldered opening in shoe 11.

Collar 18 is of hardened material and preferably includes sharp edges splines 22 designed to cut into the edges of the opening in shoe 11 as the collar is pressed under high pressure into its assembled position therewith. Splines 22 assure a strong assembly and prevent any possibility of the collar rotating relative to shoe 11.

Although the outer surface of shoe 11 may be formed with low-height sharp burrs adapted to cut through any insulative coating sometimes present on cable shield jackets, superior results are achieved using the thin flexible resilient shim member 12 shaped as shown. This shim assures a more positive electrical contact with the shield jacket in that it has a multiplicity of low-height sharp burns protruding from its outer surface and substantially harder than the material of the shield. Desirably, shim 12 also has a greater transverse curvature than shoe 11 with the result that when the shim is compressed against the shield jacket its arch is very substantially flattened causing the sharp burrs to cut short channels into the coating film on the shield as it penetrates into the shield. A central opening 25 through shim 12 loosely accommodates the clamping shank 14.

Figure 2:
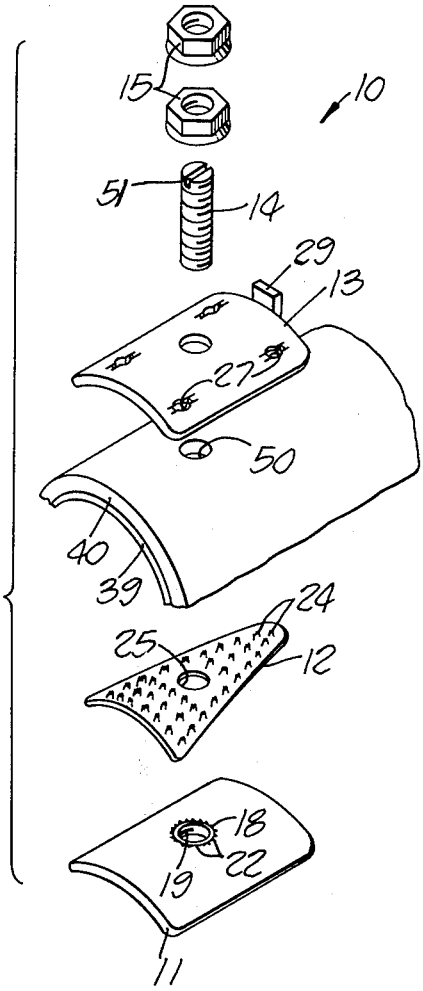
FIG. 2 is an exploded view of the components of the FIG. 1 bonding assembly disposed in proper assembly positions on the opposite sides of a cable shield and sheath.
Figure 3:
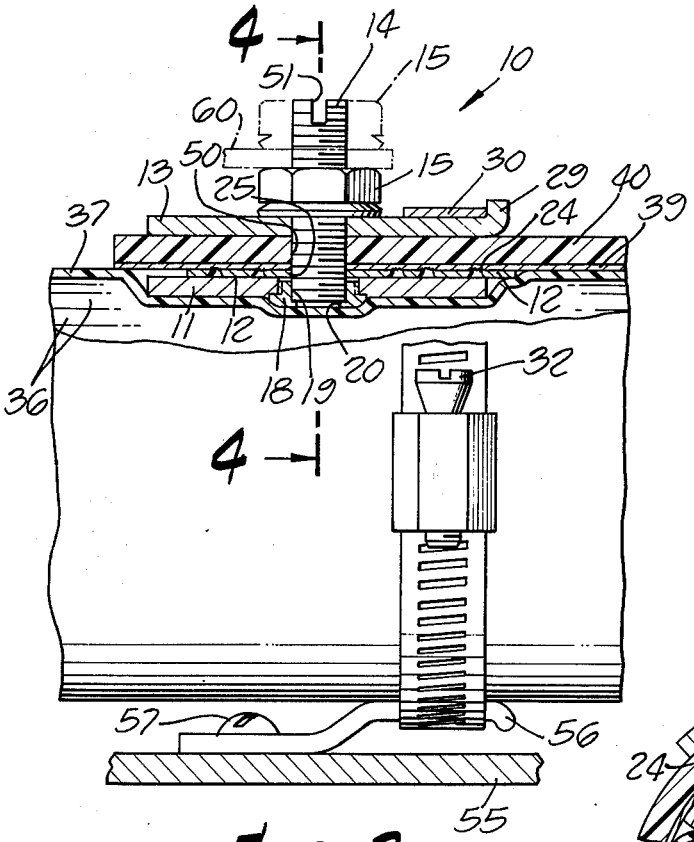
FIG. 3 is a view partly in section on an enlarged scale through a cable after assembly of the bonding assembly thereto.
Figure 4:
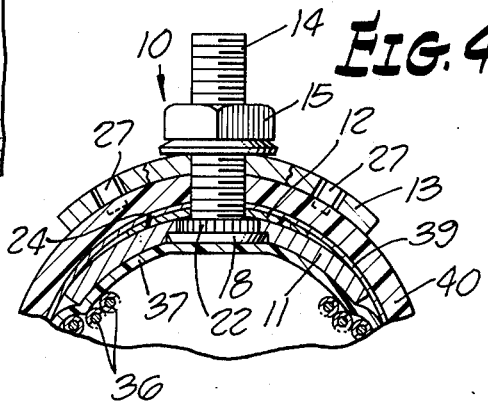
FIG. 4 is a fragmentary cross sectional view taken along line 4—4 on FIG. 3.

Outer shoe 13 is similar in contour and size to shoe 11, but preferably includes short tangs 27 best shown in FIGS. 2 and 4 which project downwardly a short distance from its inner surface so as to penetrate into the outer surface of the cable shield jacket thereby holding the outer shoe against rotation during the clamping operation. Additionally, an outstruck tank 29 protrudes from one end of the outer shoe and serves to hold a clamping band 30 in place while the clamping nut 32 for the band is being tightened.

The assembly of the improved bonding assembly 10 to a typical shielded cable is a simple operation. FIG. 1 shows a conventional telephone cable 35 having a multiplicity of pairs of small conductors 36 embraced by a thin plastic tube 37. Around tube 37 is a thin metal foil shield jacket 39 enclosed by a thick high-strength plastic sheath 40 of suitable plastic or elastometic material.

Usually a sufficient length of conductors 36 is unsheathed by removal of a portion of shield jacket 39 and sheath 40 in a manner well known to those skilled in this art. Initially the inner pastic tube 37 is left intact about conductor pairs 36. This facilitates insertion of a special punch tool 42 into the end of the sheath between tube 37 and the inner surface of shield jacket 39. For this purpose tool 42 is preferably provided with a thin jaw member 43 having a rounded forward end formed with an opening 44 aligned with the cylindrical punching die 45 carried by the other jaw member 46. A stop shoulder 47 formed at the base end of jaw 43 engages the end of the cable sheath when jaw 43 has been inserted beneath the shield jacket by an appropriate distance, an operation conveniently carried out while holding the conductors curved away from the tool in a manner illustrated in FIG. 1. A hole 50 is then punched through the jacket 39 and sheath 40. Thereafter, shim 12 is placed against the outer surface of shoe 11 and firmly held while being shifted edgewise beneath jacket 39 using a screwdriver or other tool if necessary to provide an entry space for these components. As components 11, 12 are shifted slightly beyond the end of the sheath, threaded opening 19 and end opening 25 of the skim will be in alignment with openings 50 through the shield and sheath. Thereafter shank 15 is installed through these openings and tightened using a tool applied to the kerf 51 at the outer end of the shank. The threaded shank preferably has a snug mating fit with threads 19, the shank being tightened until it firmly abuts against stop shoulder 20.

Thereafter, outer shoe 13 is placed over shank 14 and at least one of the clamping nuts 15 is wrenched until shield and sheath 39, 40 are tightly compressed between two shoes. During this tightening operation shim 12 is gradually flattened against the inner shoe causing burrs 24 to cut short grooves as they penetrate into the shield.

If the cable end is being terminated at a pedestal, a metal support frame, or any other grounded metallic member such as the grounded frame 55 (FIG. 3), the bonding operation is completed by applying a metallic clamping band 30 about the cable while seated inwardly of the outstruck tang 29. The diametrically opposed sides of the cable grounding clamp are then clamped against a lug 56 held clamped to member 55 by screw 57. In this manner the cable is not only rigidly clamped to frame 55, but, additionally, a high capacity grounding path for the bonding assembly is provided. If clamp 30 is not being used for grounding purposes a strap or heavy gauge conductor, indicated at 60 (FIG. 3), may be clamped to the outer end of shank 40 by a second lock nut 15.

Figure 5:
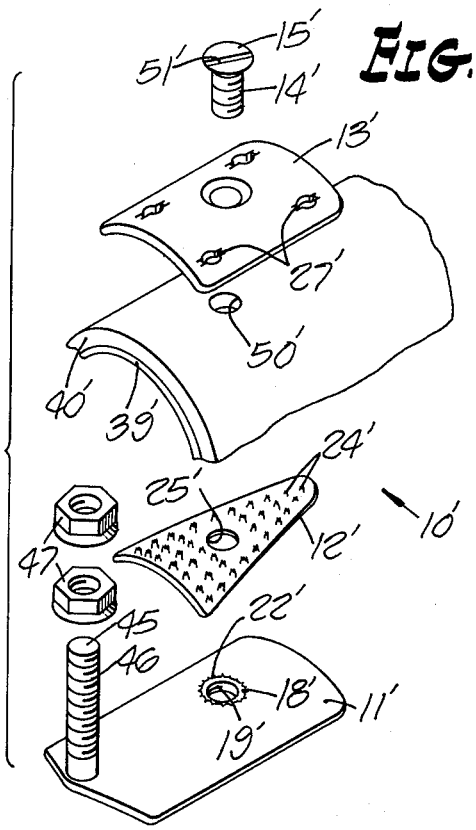
FIG. 5 is an exploded view similar to FIG. 2 of a second preferred embodiment of the invention.
Figure 7:
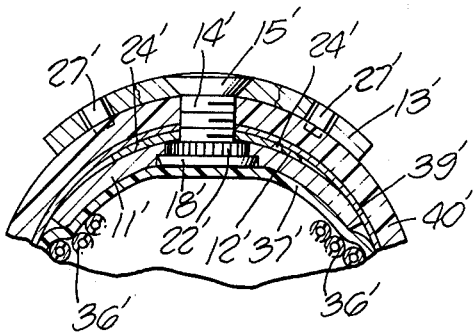
FIG. 7 is a fragmentary cross sectional view taken along line 7—7 on FIG. 6.
Figure 6:
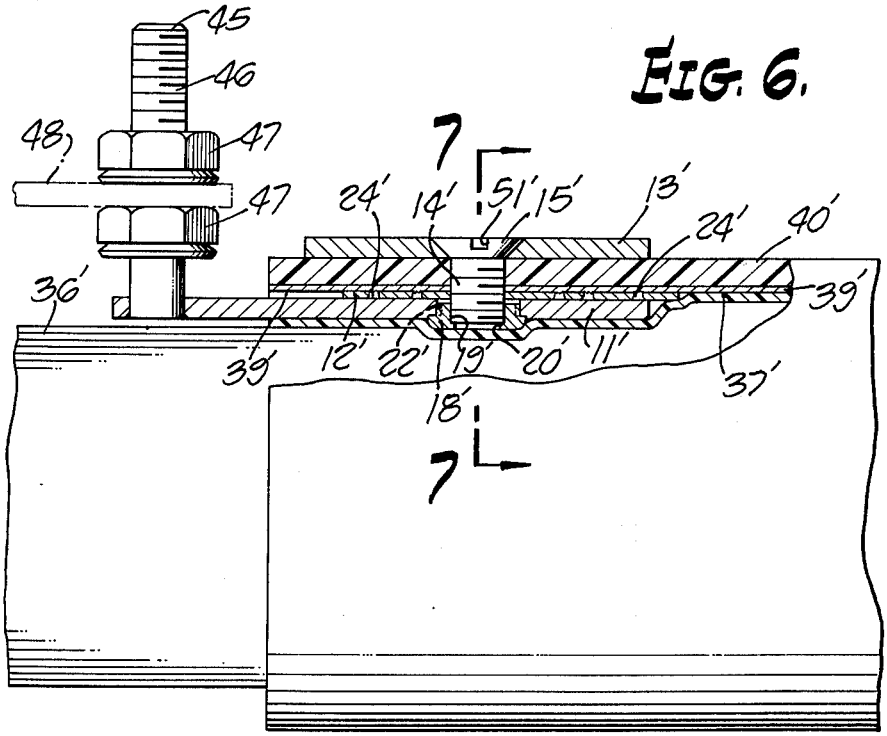
FIG. 6 is a side elevational view on an enlarged scale and showing the FIG. 2 construction assembled astride a cable shield and sheath, parts being broken away to show details of the assembly.

Referring to FIGS. 5–6 there is shown a second preferred embodiment of the invention bonding assembly, designated generally 10′, and wherein the same or similar components are represented by the same reference characters as in FIGS. 1–4 but distinguished therefrom by a prime. It will be observed that the clamping shank 14′ has a headed outer end 15′ serving as a retainer and cooperating with the shank to clamp the outer shoe 13′ rigidly and firmly against cable sheath 14′ as the inner end of the shank mates with the threads of the inner shoe to clamp the latter along with the shim 12′ forcibly against cable shield 39′. The length of the clamping shank 13′ is rather accurately selected for use with a cable sheath of a particular thickness. In this connection it will be understood that the threaded insert 18′ may project above the surface of the inner shoe 11′ to facilitate initial assembly of the parts and to provide an adequate length of threads for high pressure clamping action as fastener 14', 15' is tightened using a screwdriver applied to kerf 51'.

It will be observed from the drawings that one of the two shoes, such as shoe 11, is longer than the other and has a shank 45 fixed to and extending outwardly from the projecting end of the shoe. Shank 45 may be staked, swaged or otherwise permanently assembled to the shoe. This shank may be threaded as is indicated at 45, and provided with clamping nuts 47, 47 for convenience in securing a grounding strap or conductor indicated at 48 to the shank. Alternatively the shank may be left unthreaded and equipped with soft retainer ringlets in lieu of nuts 47, 47 clenchable against the shank in known manner to hold conductor 48 clamped to the shoe.

While the particular improved bonding assembly and method of installing the same on a shielded cable herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

We claim:

1. That improvement in a solderless bonding assembly for use in completing a high-strength high-capacity bonding connection to a shield jacket of a sheathed cable in an area concealed beneath the cable sheath, said improved bonding assembly comprising: separate inner and outer metal shoes each having a hole in the mid-portion thereof, said hole in said inner shoe being threaded, said inner shoe alone being insertable edgewise directly beneath one end of the cable shield jacket until said threaded hole is in registry with aligned holes spaced inwardly from an end edge of the superimposed portions of the cable sheath and shield jacket and which aligned holes are sized to accommodate a clamping shank for said shoes, an elongated metal shank threaded from end to end thereof and having one threaded end insertable serially first through the hole in said outer show, the aligned holes in the cable sheath and shield jacket and then into the threaded hole of said inner shoe, and retainer means on said shank receiver to hold the cable sheath and shield jacket rigidly and forcibly clamped between said inner and outer shoes to provide a high capacity bonding connection to the cable shield jacket and a high strength mechanical connection to intervening superimposed portions of the cable sheath and the cable shield jacket, the outer surface of said inner shoe and the inner surface of said outer shoe being complementary and being substantially parallel throughout their entire areas when assembled with said shank and the cable sheath and shield jacket in the manner set forth, the inner surface of the outer shoe being substantially continuous throughout its entire area.

2. That improvement defined in claim 1 characterized in the provision of means preventing the threaded end of said shank from assembly into said threaded hole so as to project beyond the inner end of said threaded hole.

3. That improvement defined in claim 1 characterized in so forming said threaded hole and the adjacent threaded end of said shank to limit the threaded assembly of the one to the other.

4. That improvement defined in claim 1 characterized in that said threaded hole includes a barrier limiting the distance said shank can be assembled thereinto.

5. That improvement defined in claim 1 characterized in that the innermost end of said threaded hole is without a screw thread for the threaded end of said clamping shank.

6. That improvement defined in claim 1 characterized in that said threaded hole is formed in a metallic member having a press fit in an opening through said inner shoe,

7. That improvement defined in claim 1 characterized in that said inner and outer shoes are similarly arched transversely of one another and have generally coextensive surfaces lying parallel to one another in the assembled positions thereof.

8. That improvement defined in claim 1 characterized in that said outer shoe has a plurality of low height projections extending from the inner surface thereof toward the adjacent surface of said inner shoe and adapted to penetrate into the exterior surface of a cable sheath as said shoes are clamped toward one another by said retainer means.

9. That improvement defined in claim 1 characterized in that said shank is headless and includes a kerf transversely of the threads at one end to seat a screwdriver.

10. That improvement defined in claim 1 characterized in that said outer shoe includes a tang at one end portion thereof projecting outwardly away from said inner shoe upon assembly and adapted to hold a clamping band captive when said bonding assembly is assembled to a cable.

11. That improvement defined in claim 1 characterized in the provision of a resilient metallic shim having an opening therethrough accommodating said shank, said shim being arched transversely thereof with a shorter radius than the radius of the cable shield jacket, said shim having a multiplicity of sharp burrs projecting from the outer surface thereof adapted to penetrate into and scratch the inner surface of the cable shield jacket as the shim is flattened during the clamping of said inner and outer shoes toward one another during assembly to a cable.

12. That improvement defined in claim 1 characterized in that said inner shoe projects outwardly beyond one end of said outer shoe, and threaded shank means fixed to and projecting from one end of said inner shoe for use in clamping a conductive member to said inner shoe.

13. A bonding assembly as defined in claim 1 characterized in the provision of a multiplicity of short sharp burrs projecting toward said outer shoe and in electrical conducting relation to said inner shoe, said sharp burrs being adapted to penetrate into a cable shield jacket as said shoes are compressed toward one another by tightening said retainer means along said threaded shank.

14. That improvement defined in claim 1 characterized in that said threaded hole is formed in an insert member immovably seated in an opening through said inner shoe.

15. That improvement defined in claim 14 characterized in that said insert member is formed of high strength material and includes a barrier at the inner end of the threaded hole therein limiting the distance said shank can be assembled thereinto.

16. A bonding assembly for use in providing a high-capacity high-strength bonding connection to a shielded cable having a tough plastic sheath, said bonding assembly comprising three principal separate components installable in sequence on a shielded cable underlying the cable shield.

17. A bonding assembly as defined in claim 16 characterized in that said threaded shank means is threaded from end to end thereof and includes threaded nut means mounted on the end thereof remote from said

UNITED STATES PATENT AND TRADEMARK OFFICE

CERTIFICATE OF CORRECTION

PATENT NO. : 3,963,299

DATED : June 15, 1976

INVENTOR(S) : John T. Thompson and George W. Gillemot

It is certified that error appears in the above-identified patent and that said Letters Patent are hereby corrected as shown below:

Column 1, line 12, "neded" should be --need--;

Column 1, line 16, "out" should be --our--;

Column 1, line 27, "of (after "slit") should be --or--;

Column 1, line 37, after "By" insert --the--;

Column 1, line 45, "threshold" should be --threaded--;

Column 1, line 56, "shows" should be --shoes--;

Column 1, line 62, "burns" should be --burrs--;

Column 2, line 30, "are" (after "shoes") should be --and--;

Column 3, line 27, "edges" should be --edged--;

Column 3, line 55, "tank" should be --tang--;

Column 5, line 43, claim 1, "show" should be --shoe--; and

Column 5, lines 45 and 46, claim 1, "re-ceiver" (after "shank") should be --effective--.

Signed and Sealed this

Fifth Day of October 1976

[SEAL]

*Attest:*

RUTH C. MASON
*Attesting Officer*

C. MARSHALL DANN
*Commissioner of Patents and Trademarks*